US006467110B1

(12) United States Patent
Ketcher

(10) Patent No.: US 6,467,110 B1
(45) Date of Patent: Oct. 22, 2002

(54) DOCK POST SUPPORTED HAMMOCK

(76) Inventor: Randy J. Ketcher, 1772 Shorewood La., Mound, MN (US) 55364

( * ) Notice: Subject to any disclaimer, the term of this patent is extended or adjusted under 35 U.S.C. 154(b) by 0 days.

(21) Appl. No.: 09/675,367

(22) Filed: Sep. 29, 2000

(51) Int. Cl.[7] ..... A45F 3/24; A45F 3/22
(52) U.S. Cl. ..... 5/127; 5/129; 5/120
(58) Field of Search ..... 5/127, 128, 129, 5/130, 120, 122

(56) References Cited

U.S. PATENT DOCUMENTS

| | | | | | |
|---|---|---|---|---|---|
| 218,001 | A | | 7/1879 | Derby | 49/190 |
| 280,081 | A | | 6/1883 | Rich | 5/127 |
| 390,692 | A | | 10/1888 | Miller | 49/396 |
| 531,727 | A | * | 1/1895 | Keegan et al. | 5/129 |
| 672,228 | A | * | 4/1901 | Huff | 5/127 |
| 679,963 | A | | 8/1901 | Hayward | 5/129 |
| 944,784 | A | | 12/1909 | Hand | 5/129 |
| 2,382,528 | A | | 8/1945 | Anderegg | 5/128 |
| 2,524,499 | A | * | 10/1950 | Weir | 5/127 |
| 3,304,656 | A | | 2/1967 | Dvorak | 49/247 |
| 3,418,671 | A | | 12/1968 | Marotta | 114/373 |
| 3,593,352 | A | * | 7/1971 | Britt | 5/127 |
| 3,675,258 | A | | 7/1972 | Osmundson | 114/368 |
| 4,240,278 | A | | 12/1980 | Linder | 70/101 |
| 4,360,936 | A | * | 11/1982 | Keller | 5/11 X |
| 5,297,302 | A | | 3/1994 | Anderson | 5/127 |
| 5,392,476 | A | * | 2/1995 | Williams | 5/127 |
| 5,414,873 | A | | 5/1995 | Wolf | 5/122 |
| 5,803,003 | A | | 9/1998 | Vickers | 114/44 |
| 5,974,826 | A | | 11/1999 | Baldwin et al. | 62/457.2 |
| 5,983,422 | A | * | 11/1999 | Bayless | 5/120 |

* cited by examiner

*Primary Examiner*—Robert G. Santos
(74) *Attorney, Agent, or Firm*—Merchant & Gould P.C.

(57) ABSTRACT

A hammock and support system is disclosed which uses a simple boat dock post and dock structure to support the entire weight of a hammock and person lying in the hammock.

12 Claims, 4 Drawing Sheets

DOCK POST SUPPORTED HAMMOCK

FIELD OF THE INVENTION

The invention relates to hammock support systems.

BACKGROUND OF THE INVENTION

Hammocks are usually supported by a framework holding each end of the hammock, with the framework having a plurality of feet, bars or other support structure supporting the framework on solid ground. Typical examples are shown in U.S. Pat. Nos. 5,414,873 and 5,297,302. There have been some efforts to attach hammocks to the side of a home as in U.S. Pat. No. 2,382,528.

SUMMARY OF THE INVENTION

This invention is a hammock and support system, which uses a single boat dock post and dock structure to support the entire weight of a hammock and the person lying in the hammock.

DETAILED DESCRIPTION OF THE PREFERRED EMBODIMENT

Before my invention, hammocks have always been placed so that they are over solid ground, often attached between two trees or objects, or attached to some framework which sits on the ground, or even attached to a house.

I have found that a hammock can be located over water. This is quite an advantage because the hammock user has a greater feeling of freedom when hanging over water. Further breezes over water are cooler than over ground. Even tanning enthusiasts will find that more sun can be collected when lying in a hammock over water.

I have found that the hammock can be attached to a single boat dock post on the side or end of a boat dock. The dock post and dock sufficiently distribute the forces created by the weight of an individual in the hammock.

Boat docks are constructed with some amount of metal framework and wood decking. The metal framework is used to attach the dock posts, which are driven into the lakebed, to the wood decking. In older docks the metal framework consists of a simple metal bracket which is attached to a wooden dock frame. In newer dock designs, the dock has an entire metal framework shaped like the dock and the wood is laid on top of the framework, I have found that the metal post, and dock to which it is attached, is strong enough to support a hammock frame and a person lying in the hammock.

Metal dock posts are driven into the lakebed and their tops typically extend two to four feet above the top of the deck surface. My hammock frame is made to be attached to such boat dock posts. Boat dock posts typically use schedule 40 steel posts, and they are typically 1½ inch in diameter. The steel can be galvanized if desired.

Figure 1:
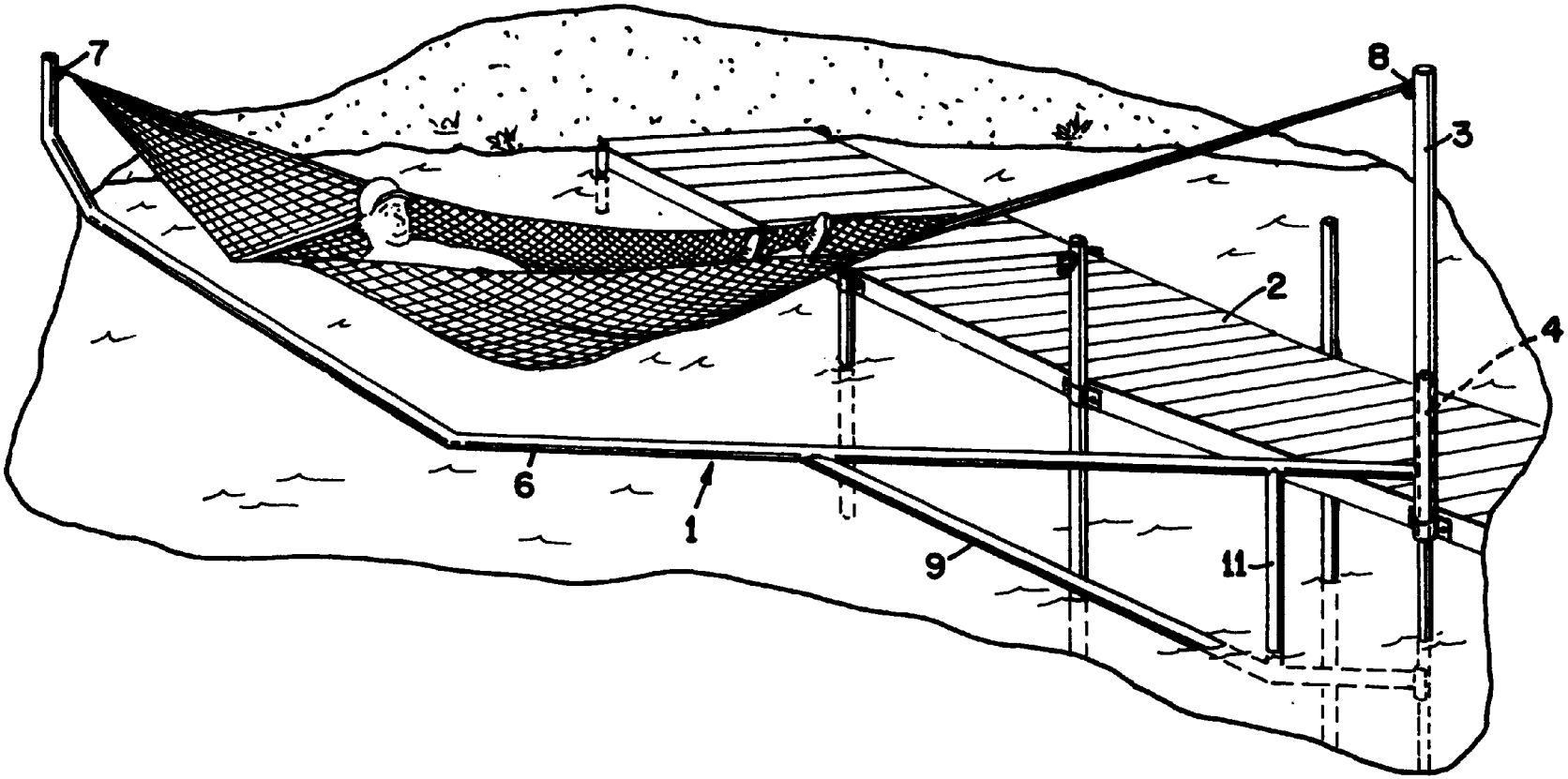
FIG. 1 is a perspective view of an embodiment of the hammock structure of the present invention attached to a boat dock.
Figure 2:
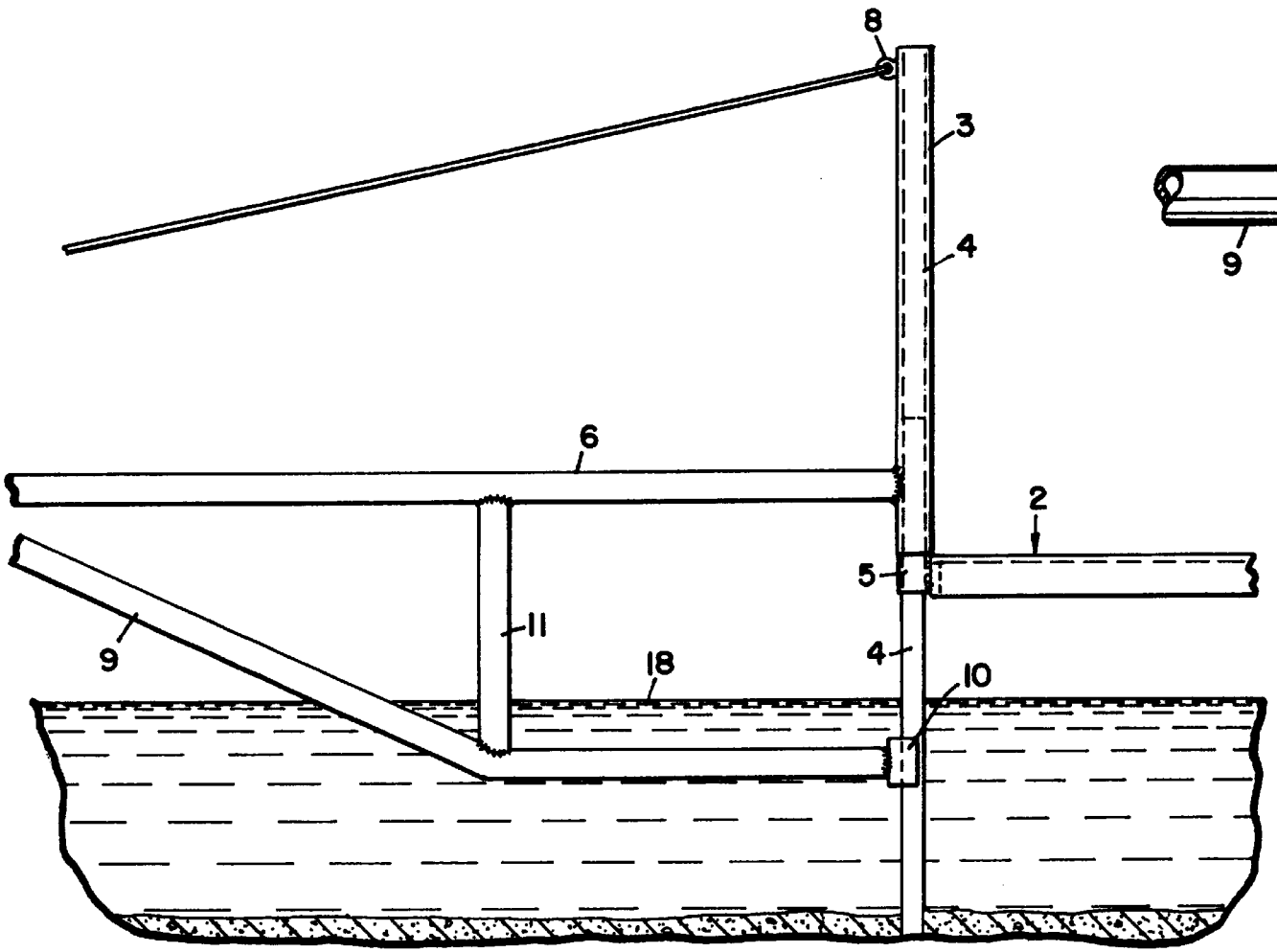
FIG. 2 is a perspective view of the hammock structure of FIG. 1 in the region where the structure is attached to a boat dock post, showing the relationship of the hammock sleeve, the dock post, and the dock bracket.

Referring first to FIGS. 1 and 2, I have shown a perspective view of the hammock frame 1 attached to a dock 2 with a person lying in the hammock. The frame 1 has a sleeve 3 constructed of two-inch diameter schedule 40 steel pipe. The steel for the hammock support can be galvanized or made from other sturdy material. As can be seen in FIGS. 1 and 2, the sleeve 3 slides over the top of a boat dock post 4. Post 4 is driven into the lakebed. The sleeve 3 is constructed so that it sits on top of the metal dock bracket 5. Sleeve 3 is free to rotate about the post 4 supported by the dock bracket 5.

Referring to FIGS. 1 and 2, the hammock frame 1 has a main post 6, which is attachable to the sleeve 3 by some means such as welding. In the preferred embodiment, the main post 6 is also constructed from schedule 40 steel pipe. The main post has an attachment loop 7 for attaching one end of the hammock. A second attachment loop 8 is located on the sleeve for attaching the other end of the hammock.

Figure 3:
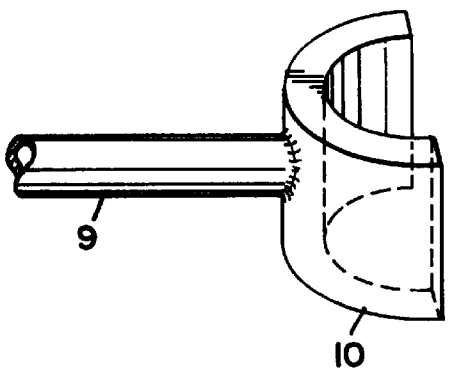
FIG. 3 is a view of the bottom part of the hammock support structure, journaling around the dock post.

The hammock frame also has a support post 9, which is attached to the main post near the middle of the main post. The attachment can be a weld or other means. Post 9 can be one straight piece, or it can be bent in the middle, as shown, or it can consist of two pieces that are joined by weld or telescopic joint. The second end of the support post 9 journals about the dock post 4. That journal arrangement can be seen in FIG. 3. The end of the post 9 has a journal bracket 10 welded to the post 9. The journal bracket 10 can consist of an open piece of schedule 40, two-inch pipe. The bracket 10 fits partially around the post 4 and facilitates the rotation of the frame 1 around the dock post 4.

The frame also has a brace 11 which supports the main post 6 and the support post 9. It also can be attached by weld. It should be understood that instead of welds the various parts can be attached by the use of telescopingly mounted pipes of varying diameter such as shown in U.S. Pat. No. 5,297,302. It should also be understood that the main post 6, support post 9 and brace 11 may be bent if desired or each may consist of more than one part which are attached together in some fashion. Depending on the shape of the main post 6 and the support post 9, a brace 11 may not be needed.

In operation, the hammock is brought to the side of the dock where a person can climb into the hammock. The hammock can then be pushed outward so that the sleeve 3 and journal bracket 10 rotate about the post 4 placing the user over water. A rope can be attached between the hammock and the dock to allow the user to move the hammock about the post 4 by pulling the rope. Additionally, a gate latch may be provided on a dock pipe 4, which attaches to the hammock to hold the hammock against the dock when not in use.

Figure 4:
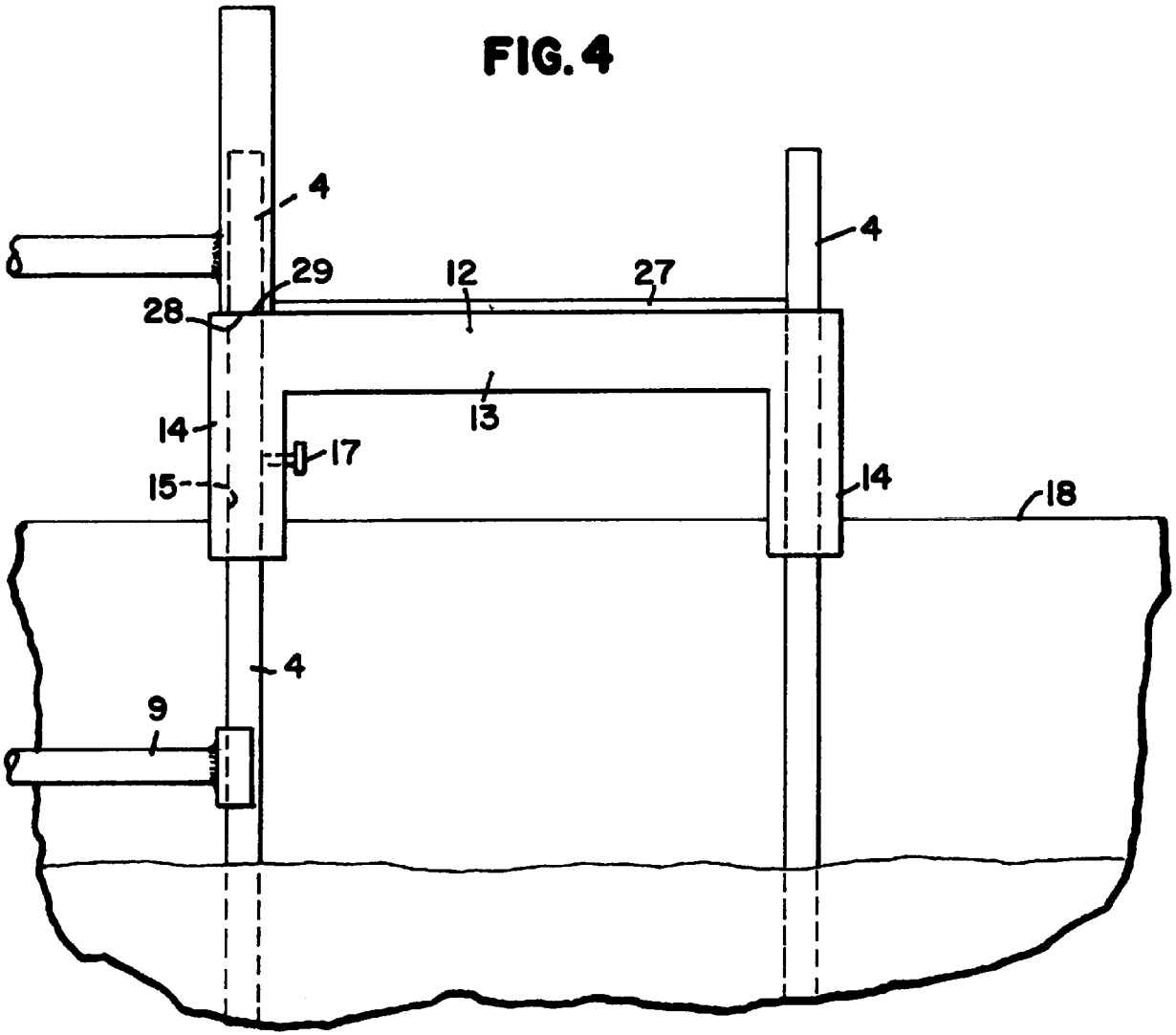
FIG. 4 is a view of a part of the hammock structure showing in more detail a typical metal frame dock.

FIG. 4 shows in more detail the structure of a typical metal frame dock 12 to which my invention may be attached. The metal dock can be constructed from steel or some other solid structure. Typically, metal docks have a framework 13 on which wood decks 27 are placed. The metal dock has side brackets 14 with postholes 15 extending through them through which the dock posts 4 are inserted.

The dock posts are driven into the lakebed and they, along with the dock structure itself, distribute the forces created by the person lying in the hammock. The brackets 14 have one or more threaded holes for receiving ½ inch threaded screws 17. When the screws 17 are screwed into the holes in the brackets 14, the screws 17 will seat against the posts 4 and hold the metal frame 13 to the post 4 and securely above the water 18. When the frame is rotated about the post 4, as I have already described, the bottom 28 of the sleeve 19 rides over the top 29 of the dock framework 13, and the support post 9, with its bracket journal 10 rotates about the dock post 4.

Figure 7:
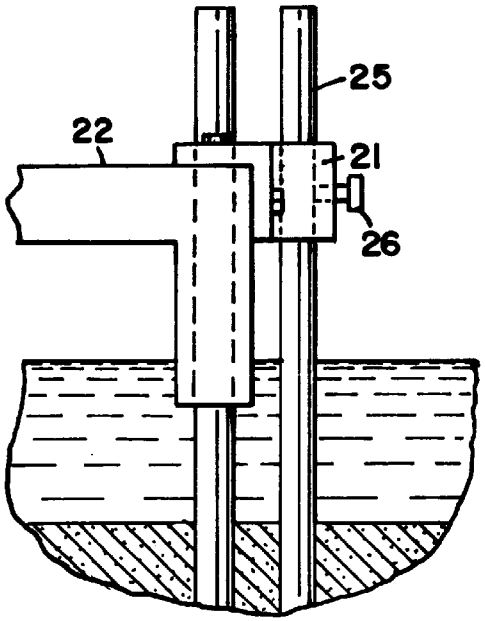
FIG. 7 is a second side view of the bracket system of FIG. 5.
Figure 5:
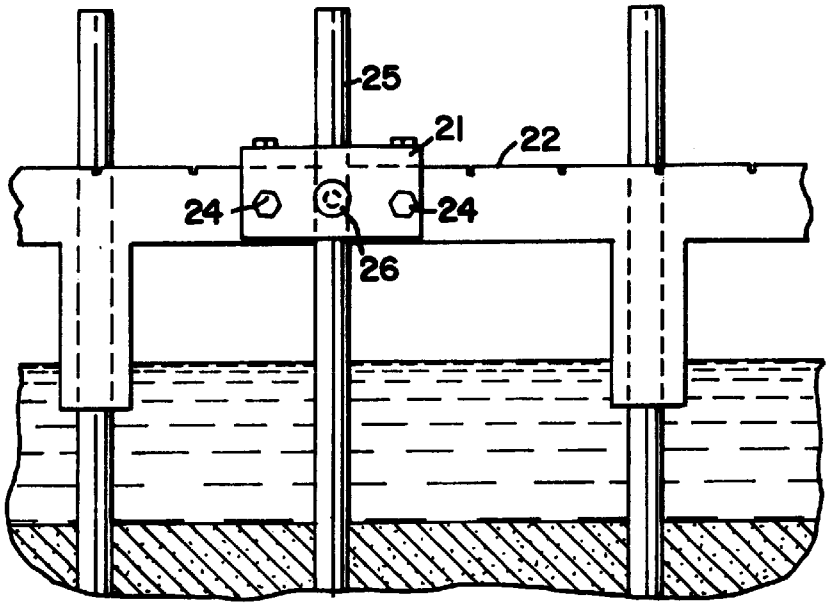
FIG. 5 shows a side view of a bracket system that can be used for attaching the hammock to a dock.
Figure 6:
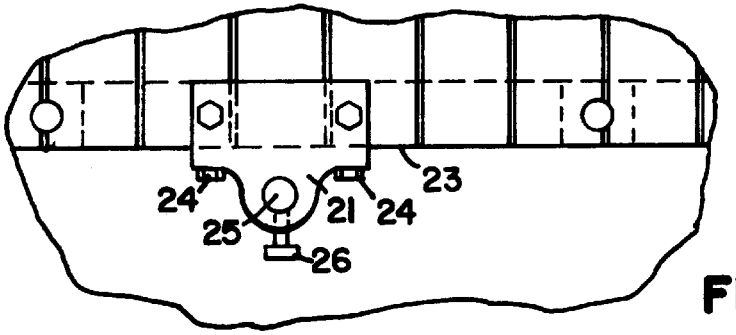
FIG. 6 is a top view of the bracket system of FIG. 5.

In some cases, because of the nature of the dock structure, it may be advantageous, to attach a separate bracket kit to the side of the dock and attach the hammock frame to a post attached to the bracket kit. For instance, some docks are on wheels and they do not have a number of posts that are driven into the lakebed for distributing the forces created by the person in the hammock. Referring to FIGS. 5 through 7, the top and side views of the bracket and frame are shown. A generally L-shaped bracket 21 is attached to the top 22 and side 23 of the frame with screws or nails 24. The post 25 is inserted through a hole in the bracket 21 and held to the dock by screwing in threaded screw 26. The hammock frame is then placed over the post 25 for use as already described.

While the invention is described in the context of a preferred embodiment, it should be appreciated that the invention is not limited by the preferred embodiment, but includes various embodiments within the scope of the claims.

I claim:

1. A hammock frame configured to be attached to a generally cylindrical boat dock post having an outside diameter comprising:

a sleeve having an inside diameter larger than that of the outside diameter of the dock post for insertion over said dock post;

a main post attachable to said sleeve and extending generally perpendicular to said sleeve, said main post having a first hammock attachment at its far end;

a second hammock attachment located on said sleeve;

a support post extending generally perpendicular to said sleeve, said support post attachable at a first end to said main post and having a second end configured to rotate about said boat dock post.

2. A hammock frame configured to be attached to a cylindrical boat dock post having an outside diameter comprising:

a cylindrical sleeve having an inside diameter larger than the outside diameter of said cylindrical dock post;

a main post attachable TO said cylindrical sleeve and extending generally perpendicular to said cylindrical sleeve, said main post having a first hammock attachment al the far end from said sleeve;

a second hammock attachment located on said sleeve;

a support post extending generally perpendicular to said sleeve attachable at a first end to said main post and having a second end configured to rotate about said boat dock post.

3. The hammock frame of claim 2 further including a brace post extending from said main post to said support post.

4. The hammock frame of claim 3 where said support post second end includes a journal bracket with a radius larger than said boat dock post for allowing said frame to rotate about said boat dock post.

5. The hammock frame of claim 2 including a bracket attachable to the side of said dock post and having a boat dock post hole for receiving said boat dock post.

6. A hammock frame adapted to be configured to a metal frame boat dock having boat dock posts with an outside diameter comprising:

a sleeve having an inside dimension larger than the outside diameter of the dock post for insertion over one of said boat dock posts, said cylindrical sleeve being supportable at its bottom end by the metal frame boat dock;

a main post attachable to said sleeve and extending generally perpendicular to said sleeve, said main post having a first hammock attachment at its far end;

a second hammock attachment located on said sleeve;

a support post extending generally perpendicular to said sleeve, said support post attachable at a first end to said main post and having a second end configured to rotate about one of said boat dock posts.

7. The hammock frame of claim 5 further including a brace post extending from said main post to said support post.

8. The hammock frame of claim 6 where said support post second end includes a journal bracket with a radius larger than said boat dock post for allowing said frame to rotate about one of said boat dock post.

9. A hammock and hammock frame configured to be attached to a metal frame boat dock having boat dock posts each with an outside diameter comprising:

a sleeve having an inside dimension larger than that of the outside of the dock post for insertion over one of said boat dock posts, said cylindrical sleeve being supportable at its bottom end by the metal frame boat dock;

a main post attachable to said sleeve and extending generally perpendicular to said sleeve, said main post having a first hammock attachment at its far end;

a second hammock attachment located on said sleeve;

said hammock attached to said first and second attachments;

a support post extending generally perpendicular to said sleeve, said support post attachable at a first end to id main post and having a second end configured to rotate about one of said boat dock posts.

10. The hammock frame of claim 9 further including a brace post extending from said main post to said support post.

11. The hammock frame of claim 10 where said support post second end includes a journal bracket with a radius larger than said boat dock post for allowing said frame to rotate about one of said boat dock posts.

12. A hammock frame configured to be attached to a boat dock post comprising:

a main hammock post configured to be supported by and journaled about said dock post, said main hammock post extending generally perpendicular to said dock post and carrying a first hammock attachment near said boat dock post;

a second hammock attachment located near the opposite end of said main hammock post;

a support post extending generally perpendicular to said dock post, said support post attachable at a first end to said main hammock post and having a second end configured to be journaled about said boat dock post.

* * * * *

UNITED STATES PATENT AND TRADEMARK OFFICE

CERTIFICATE OF CORRECTION

PATENT NO. : 6,467,110 B1
DATED : October 22, 2002
INVENTOR(S) : Ketcher

It is certified that error appears in the above-identified patent and that said Letters Patent is hereby corrected as shown below:

Column 3,
Line 55, “al” should read -- at --

Column 4,
Line 43, “id” should read -- said --

Signed and Sealed this

Eighteenth Day of March, 2003

JAMES E. ROGAN
*Director of the United States Patent and Trademark Office*